US005934941A

United States Patent [19]

Hirai et al.

[11] Patent Number: 5,934,941

[45] Date of Patent: Aug. 10, 1999

[54] CARD BUS CONNECTOR AND A METHOD OF MOUNTING THE SAME ON AN ASSOCIATED PRINTED CIRCUIT BOARD

[75] Inventors: Yuji Hirai; Kenichi Yotsutani, both of Tokyo, Japan

[73] Assignee: Honda Tsushin Kogyo Co., Ltd., Tokyo, Japan

[21] Appl. No.: 08/937,114

[22] Filed: Sep. 24, 1997

[30] Foreign Application Priority Data

Feb. 13, 1997 [JP] Japan ..... 9-028766

[51] Int. Cl.[6] ..... H01R 13/648

[52] U.S. Cl. ..... 439/607; 439/608; 439/609

[58] Field of Search ..... 395/282, 800, 395/250; 439/64, 157, 144, 607, 608, 609; 361/395, 756

[56] References Cited

U.S. PATENT DOCUMENTS 4,695,925 9/1987 Kodai et al. ..... 361/395

5,503,564 4/1996 Futatsugi et al. ..... 439/157

5,649,224 7/1997 Scheer ..... 395/800

*Primary Examiner*—Ayaz R. Sheikh

*Assistant Examiner*—Tim Vo

*Attorney, Agent, or Firm*—Nikaido, Marmelstein, Murray & Oram LLP

[57] ABSTRACT

Disclosed are an improved card connector and a method of mounting the same on an associated printed circuit board. The card connector comprises an insulating housing having contact pieces fixed therein and a shield plate detachably fixed to the surface of the insulating housing. Such a card connector can be mounted to the associated printed circuit board by: soldering the leads of the contact pieces to selected conductors in the printed circuit; and then soldering the leads of the shield to another selected conductors in the printed circuit. The two-step separate soldering permits the contact-to-conductor solderings to be checked in the absence of overhanging grounding leads. Therefore, incomplete or defective solderings, if found in the contact-to-conductor solderings would be fixed with much less difficulty than the cluster of overhanging and underlying lead-to-conductor solderings.

8 Claims, 4 Drawing Sheets

CARD BUS CONNECTOR AND A METHOD OF MOUNTING THE SAME ON AN ASSOCIATED PRINTED CIRCUIT BOARD

BACKGROUND OF THE INVENTION

1. Field of the Invention

The present invention relates to a connector structure of a function-expanding card such as a PC card or memory card to be inserted in a card slot made in a personal computer for expanding the function of the personal computer.

2. Description of Related Art

Referring to FIG. 16, a PC card 1 is inserted in the card bus connector 2 mounted in a personal computer 7. Specifically the front of the PC card is inserted in the card slot of the card bus connector 2 until its female part 1*a* is mated with the male part of the card bus connector 2, thereby making a required electric connection between the CPU of the personal computer 7 and the PC card 1.

The card bus connector 2 has a card-ejection arm 3 pivoted about a stationary metal post 8, and the card-ejection arm 3 is operatively connected to a card-ejection lever 4 and operation buttons 5 and 6, which appear outside of the personal computer 7. Thus, the PC card 1 can be removably inserted in the card bus connector 2.

As seen from the drawing, the PC card 1 has a shield 1*b* on one surface of the female part 1*a*. When the PC card 1 is inserted in the card slot of the personal computer, the shield 1*b* will be electrically connected to the grounding part of a printed circuit board on the personal computer side. When making a conventional PC card, a shield 1*b* is applied to the upper surface of the card housing of synthetic resin, the front of which insulating housing makes up the body of a female part 1*a*, temporarily by using an adhesive tape (high-temperature resistive tape). Also, a plurality of female contact pieces are press-fitted in the front of the insulating housing. The so assembled female part 1*a* is applied temporarily to a printed circuit board so that the leads of the female contact pieces and shield of the female part may be put on selected conductors of the printed circuit with creamy solder applied to their contact regions.

Then, the printed circuit board having the female part temporarily applied thereto is put in a heating vessel to subject the same to reflow-soldering, thereby fixing the female part 1*a* to the printed circuit board.

As described above, creamy solder is applied to selected conductors in the printed circuit, and these selected conductors are simultaneously soldered both to the leads of the shield 1*b* and those of the parallel-arranged female contact pieces 1*a* in the insulating housing. Incomplete or defective solderings, such as solder-bridging between conductors or submerging void cannot be dealt with without difficulty; the numerous leads of the female contact pieces and shield are arranged at so narrow intervals that a tool cannot be used without difficulty.

SUMMARY OF THE INVENTION

One object of the present invention is to provide a connector structure for function-expanding cards which permits incomplete or defective lead-to-conductor solderings to be dealt with in the female part of the card bus connector.

To attain this object a card connector comprising an insulating housing having a plurality of contact pieces mounted at predetermined places in the insulating housing, and a shield plate fixed to the outer surface of the insulating housing, the leads of the contact pieces and shield plate being connected to selected conductors of an associated printed circuit, which has the card connector fixed on its substrate, is improved according to the present invention in that: the insulating housing has shield slot means made on its surface; and the shield plate has engagement means to fit in the shield slot means, thereby detachably fixing the shield plate to the insulating housing.

Another object of the present invention is to provide a method of mounting a card connector to an associated printed circuit board.

To attain this object a method of mounting on an associated printed circuit board a card bus connector comprising an insulating housing having a plurality of contact pieces mounted at predetermined places, and a shield plate detachably fixed to the surface of the insulating housing, is improved according to the present invention in that it comprises the steps of: putting the card connector on the substrate of the associated printed circuit; reflow-soldering the leads of the contact pieces to selected conductors of the printed circuit; attaching the shield plate onto the insulating housing; and reflow-soldering the leads of the shield plate to other selected conductors of the card printed circuit, thus mounting the card connector on the substrate of the printed circuit.

The lead-to-conductor soldering is effected separately on the contact pieces and then on the shield. Therefore, if defective or incomplete solderings are found in the first lead-to-conductor soldering on the contact pieces, such defective or incomplete solderings can be removed or dealt with much less difficulty than such defective or incomplete solderings are found in a cluster of lead-to-conductor solderings both on the contact pieces and the shield, which cluster solderings would result if lead-to-conductor soldering were simultaneously effected both on the contact pieces and the shield.

Other objects and advantages of the present invention will be understood from the following description of a card connector according to one preferred embodiment of the present invention, which is shown in accompanying drawings:

DESCRIPTION OF THE PREFERRED EMBODIMENTS

Referring to FIGS. 1 to 4, a card-bus connector 10 comprises an elongated housing of synthetic resin 11, having a plurality of through holes 12 parallel-arranged in upper and lower rows (for instance, 34 holes in each row). The elongated housing 11 is, for example, 3.3 mm (high)×47 mm (long)×9 mm (wide).

Figure 1:
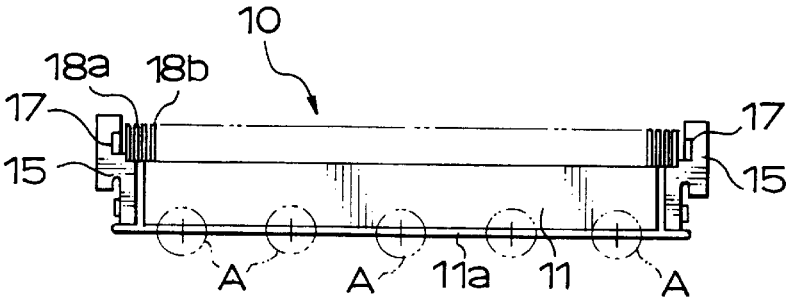
FIG. 1 is a plan view of the insulating housing of the card connector.
Figure 2:
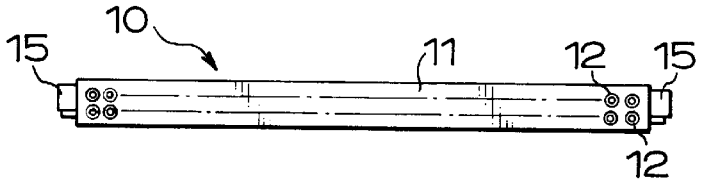
FIG. 2 is a front view of the insulating housing of the card connector.
Figure 3:
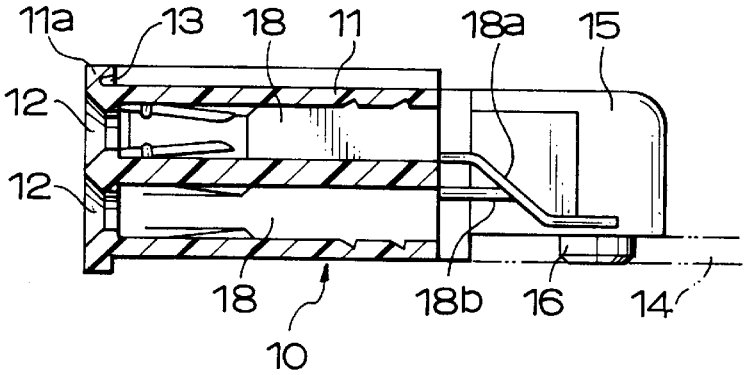
FIG. 3 is a cross section of the insulating housing of the card connector.
Figure 4:
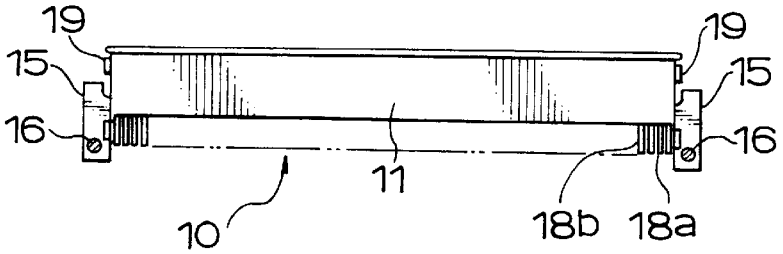
FIG. 4 is a bottom view of the insulating housing of the card connector.
Figure 5:
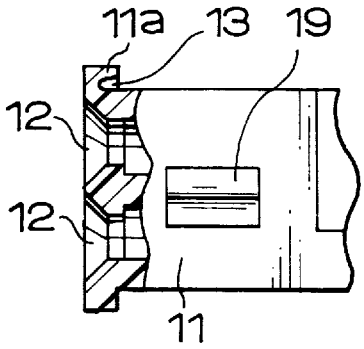
FIG. 5 is an enlarged side view of a fragment of the front of the card connector.
Figure 6:
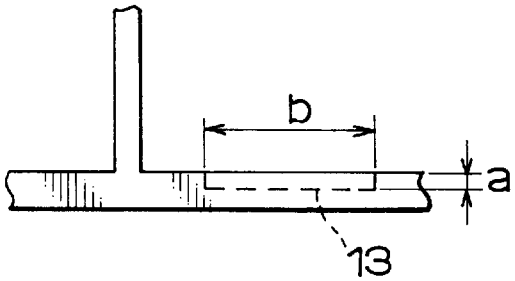
FIG. 6 shows a part of the flange of the insulating housing of the card connector.

As seen from FIGS. 1 and 3, the elongated housing 11 has a front flange 11*a* formed on its upper, front side, and the front flange 11*a* has five engagement recesses 13 made at regular intervals, as indicated by phantom circles "A" in FIG. 1. Some details of the engagement recess 13 are shown in FIGS. 5 and 6. For example, the engagement recess 13 is 0.2 mm deep (see "a") and 3 mm long (see "b").

As best seen from FIGS. 1 and 3, the elongated housing 11 has two arms 15 formed on its opposite sides for putting the insulating housing 11 in correct position on the printed circuit board 14. Each arm 15 has a positioning projection 16 on its bottom (see FIG. 3), and it has an engagement recess 17 formed inside to fix the shield 20, as later described. Also, the insulating housing 11 has projections 19 formed on its opposite side walls to fix the shield 20.

Female contact pieces 18 are press-fitted in the through holes 12 by inserting them from the rear sides of the through holes 12, so that their rear leads 18*a* and 18*b* are exposed outside, and are bent down to be in coplanar with the printed circuit board 14. Thus, all female contact pieces 18 have their leads aligned in line on the printed circuit board 14.

Referring to FIGS. 7 to 10, the shield plate 20 to be removably attached to the insulating housing 11 is a rectangular metal sheet large enough to cover the top surface of the insulating housing 11.

Figure 7:
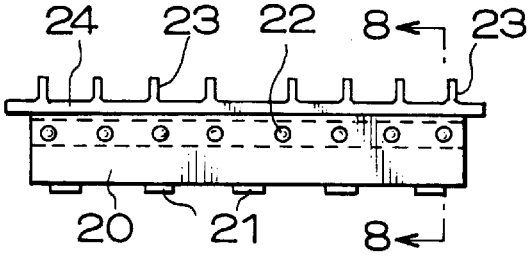
FIG. 7 is a plane view of a shield plate for use in the card bus connector.
Figure 8:
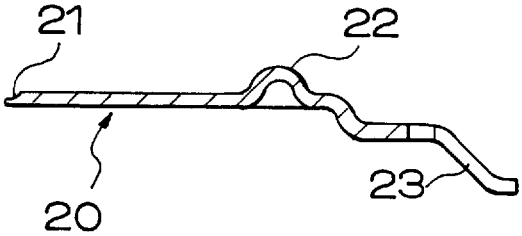
FIG. 8 is a cross section of the shield plate taken along the line 8—8 in FIG. 7.
Figure 9:
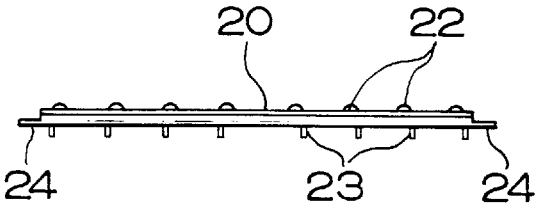
FIG. 9 is a front view of the shield plate.
Figure 10:
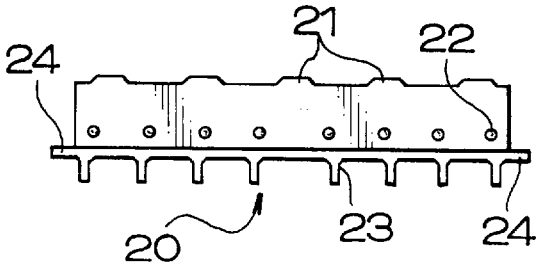
FIG. 10 is a bottom view of the shield plate.
Figure 11:
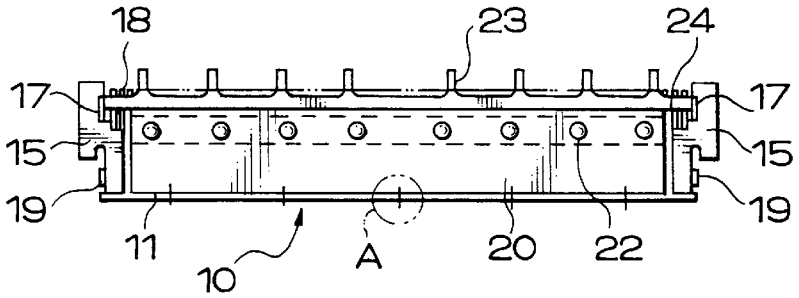
FIG. 11 is a plan view of the card connector.
Figure 12:
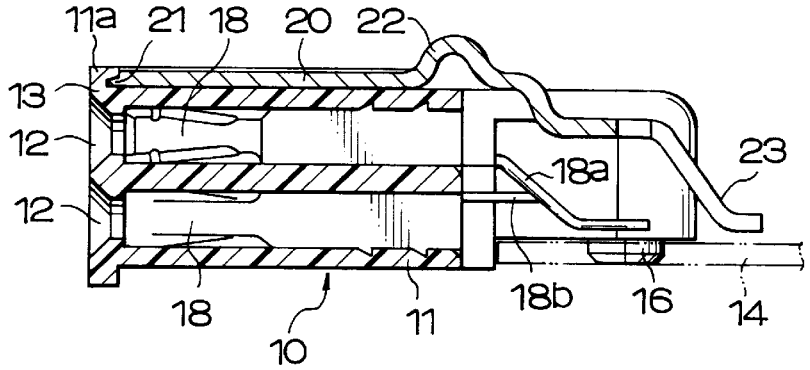
FIG. 12 is a cross section of the card connector.
Figure 13:
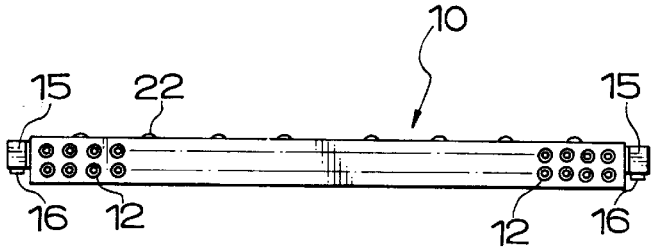
FIG. 13 is a front view of the card connector.
Figure 14:
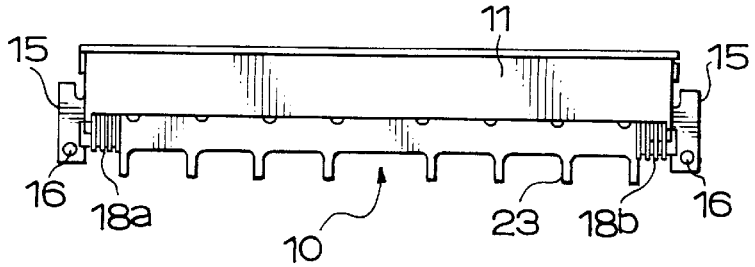
FIG. 14 is a bottom view of the card connector.
Figure 15:
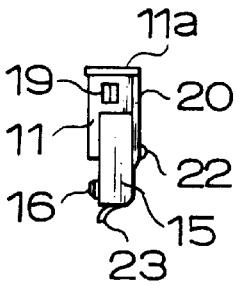
FIG. 15 is a side view of the card connector.

As shown in FIGS. 7 and 8, five front projections 21 are made by pressing and reducing the thickness of the shield plate to half, and these front projections 21 are arranged at same intervals as the recesses 13 made in the front flange 11*a* of the insulating housing 11.

Figure 16:
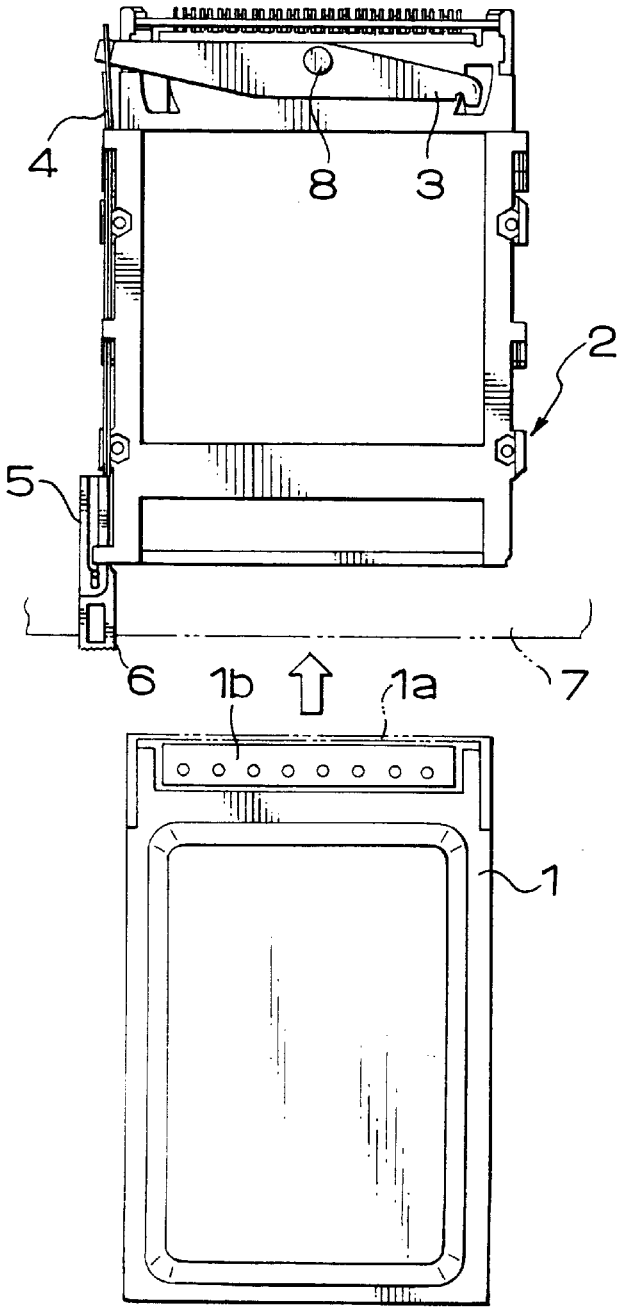
FIG. 16 PRIOR ART
FIG. 16 shows how a card bus connector is used.

Also, the shield plate 20 has eight hemispherical projections 22 formed on its top surface. These hemispherical projections 22 are arranged in line, and will be put in contact with the counter shield plate, which is provided on the card bus connector 2 (see FIG. 16).

The shield plate 20 has eight leads 23 extending backward from its rear edge, and two engagement projections 24 formed on its opposite ends. When applying the shield plate 20 to the insulating housing 11, the engagement projections 24 will fall in the recesses 17 of the opposite arms 15 to fix the shield plate 20 to the insulating housing 11.

Now, the manner in which a card bus connector 10 is mounted to an associated printed circuit board 14 is described.

First, an insulating housing 11 having numerous female contact pieces 18 press-fitted in its contact holes 12 is fixed to the printed circuit board 14 in correct position temporarily by inserting the positioning projections 16 of the insulating housing 11 in counter positioning holes made in the printed circuit board 14. Then, the leads 18*a* and 18*b* of the female contact pieces 18 (68 pins) are put on creamy solder applied to selected conductors in the printed circuit.

Thereafter, the printed circuit board 14 having the insulating housing 11 thereon is made to pass through a reflow furnace to be heated for soldering the leads 18*a* and 18*b* of the female contact pieces 18 to the selected conductors of the printed circuit.

The solderings are carefully checked, and incomplete or defective solderings, if any will be fixed. The dealing-with of such incomplete or defective solderings can be effected without much difficulty because the lead-to-conductor soldering area is free of additional hindrance such as would be caused by the overhanging grounding leads if the shield plate were applied to the top of the insulating housing 11.

After completing the soldering of the contact leads to the printed circuit a shield plate 20 is applied to the top surface of the insulating housing 11 by inserting the front projections 21 of the shield plate 20 in the engagement recesses 13 of the front flange 11*a* of the insulating housing 11, and by making the opposite engagement projections 24 of the shield plate 20 to snap in the opposite side recesses 17 of the insulating housing 11. Then, the leads 23 of the shield plate 20 are put in the creamy solder applied to the grounding conductors in the printed circuit board 14.

Again, the printed circuit board 14 having the shield plate-and-insulating housing thereon is made to pass through a reflow furnace to be heated for soldering the leads 23 of the shield plate 20 to the grounding conductors of the printed circuit.

Thus, the card connector 10 is mounted to the printed circuit board 14 through the two-step reflow soldering: the contact lead-to-circuit conductor soldering is effected, and then the grounding lead-to-circuit conductor soldering is effected.

What is claimed is:

1. A card connector electrically connected to an associated printed circuit and mounted on a substrate of an associated printed circuit board, said card connector comprising an insulating housing having a plurality of contact pieces mounted at predetermined places of the insulating housing and having leads, and a shield plate detachably fixed to a surface of the insulating housing and having other leads, the leads of the contact pieces and the other leads of the shield plate being connected to selected conductors of the associated printed circuit, the insulating housing having shield slot means made on the surface of the insulating housing; and wherein the shield plate has engagement means for fitting in the shield slot means and detachably fixing the shield plate to the insulating housing.

2. The card connector of claim 1 wherein the shield plate is a metal sheet that substantially covers the surface of the insulating housing onto which the shield plate is detachably fixed.

3. The card connector of claim 1 wherein the shield plate has front projections which are arranged to mate with corresponding recesses of the insulating housing.

4. The card connector of claim 1 wherein the shield plate has hemispherical projections on a top surface which are put in contact with a counter shield plate when a card having the card connector is inserted in a card bus connector.

5. A method of mounting and electrically connecting a card connector on an associated printed circuit board having an associated printed circuit thereon, the card connector comprising an insulating housing having a plurality of contact pieces mounted at predetermined places and having leads, and a shield plate detachably fixed to the surface of the insulating housing and having other leads, the method comprising the steps of:

temporarily mounting the card connector on the substrate of the associated printed circuit board;

reflow-soldering the leads of the contact pieces to selected conductors of the printed circuit;

attaching the shield plate onto the insulating housing; and reflow-soldering the other leads of the shield plate to other selected conductors of the printed circuit, thus mounting the card connector on the substrate of the printed circuit board and electrically connecting the card connector to the printed circuit thereon.

6. The method of claim 5 further comprising the step of correcting incompletely or defectively reflow-soldered connections between the leads of the contact pieces and the selected conductors of the printed circuit before attaching the shield plate to the insulating housing.

7. The method of claim 5 wherein the step of reflow-soldering the leads of the contact pieces is performed before the step of attaching the shield plate onto the insulating housing.

8. The method of claim 5 further comprising the step of checking the soldering connections between the leads of the contact pieces and the selected conductors of the printed circuit for defects.

* * * * *